US006046434A

United States Patent [19]

Locher et al.

[11] Patent Number: 6,046,434

[45] Date of Patent: Apr. 4, 2000

[54] GLOW PLUG HAVING A MULTI-PART SHEATH OF ADJUSTABLE LENGTH

[75] Inventors: Johannes Locher; Werner Teschner, both of Stuttgart, Germany; Jörg-Chr. Nissen, Balm bei Günsberg, Switzerland

[73] Assignee: Robert Bosch GmbH, Stuttgart, Germany

[21] Appl. No.: 09/043,688

[22] PCT Filed: Jun. 18, 1997

[86] PCT No.: PCT/DE97/01241

§ 371 Date: Jul. 1, 1998

§ 102(e) Date: Jul. 1, 1998

[87] PCT Pub. No.: WO98/04870

PCT Pub. Date: Feb. 5, 1998

[30] Foreign Application Priority Data

Jul. 26, 1996 [DE] Germany ..... 196 30 208

[51] Int. Cl.[7] ..... F23Q 7/00

[52] U.S. Cl. ..... 219/270; 123/145 A; 219/548; 338/247

[58] Field of Search ..... 219/270, 544, 219/548, 550, 546; 123/145 A, 145 R; 338/247, 232; 361/264–266

[56] References Cited

U.S. PATENT DOCUMENTS

| | | | |
|---|---|---|---|
| 2,456,080 | 12/1948 | Pe | 219/270 |
| 2,898,571 | 8/1959 | Moule et al. | 219/548 |
| 4,477,717 | 10/1984 | Walton | 219/270 |
| 5,059,768 | 10/1991 | Hatanaka et al. | 219/270 |
| 5,798,504 | 8/1998 | Schwarzkopf | 219/550 |

FOREIGN PATENT DOCUMENTS

| | | | |
|---|---|---|---|
| 36 38 164 | 9/1987 | Germany . | |
| 4-260719 | 1/1992 | Japan | 219/270 |
| 408917 | 4/1934 | United Kingdom | 213/145 A |
| 472814 | 9/1937 | United Kingdom | 219/270 |
| 2 016 596 | 9/1979 | United Kingdom . | |

*Primary Examiner*—John A. Jeffery
*Attorney, Agent, or Firm*—Kenyon & Kenyon

[57] ABSTRACT

A sheathed-element glow plug for placement in the combustion chamber of an air-compressing internal combustion engine includes a sheath, a connector element for the glow current, and a tube secured in the sheath sealed at its end facing away from the sheath. A wire filament arrangement is embedded in insulating material within the part of the tube which protrudes from the sheath. The tube functions as a glow pencil. The sheath is manufactured using a first part, a second part, and an intermediate piece. The length of the intermediate piece is adjusted depending on the desired length of the sheathed-element glow plug.

4 Claims, 3 Drawing Sheets

GLOW PLUG HAVING A MULTI-PART SHEATH OF ADJUSTABLE LENGTH

BACKGROUND INFORMATION

The present invention relates to a sheathed-element glow plug for auto-igniting internal combustion engines. Known sheathed-element glow plugs generally consist of a sheath, a connection terminal for the glow current, a tube secured to the sheath, the tube being sealed at the end facing away from the sheath, and a wire-filament-shaped resistor element which is embedded in thermally conductive insulating powder. The resistor element is arranged in the part of the tube which functions as the glow pencil and which protrudes out of the sheath. Sheaths for the various commercially available sheathed-element glow plugs vary depending on the structural shape and type of construction of the engine into which the sheathed-element glow plug is to be installed. Sheaths also differ in their length, which determines the overall length of the sheathed-element glow plugs. Therefore, for manufacturing purposes, sheaths and connection terminals for contacting the heating element must be available in great variety and in varying lengths.

SUMMARY OF THE INVENTION

The sheathed-element glow plug of the present invention has the advantage that various overall lengths can be obtained by using varying intermediate pieces. There is therefore no need to manufacture sheaths of various lengths or to have terminals of various lengths available. In this context, the required product range for component parts necessary for assembling a sheathed-element glow plug is substantially diminished. Given the possibility of manufacturing in larger quantities in series, this leads to a cost reduction for the sheathed-element glow plugs. In this context, the sheath and the terminals can be manufactured in two parts which are always fabricated in the same manner irrespective of the ultimate length of the sheathed-element glow plug. The sheath and the terminals can be adapted to the desired overall length simply by means of the variable intermediate piece.

The individual components can be joined by welding, soldering, shrinking, or pressing. It is ultimately advantageous to furnish the end faces of the sections of the sheath and of the variable intermediate pieces with an offset at the diameter, permitting them to be securely fixed in position before being joined.

Figure 1:
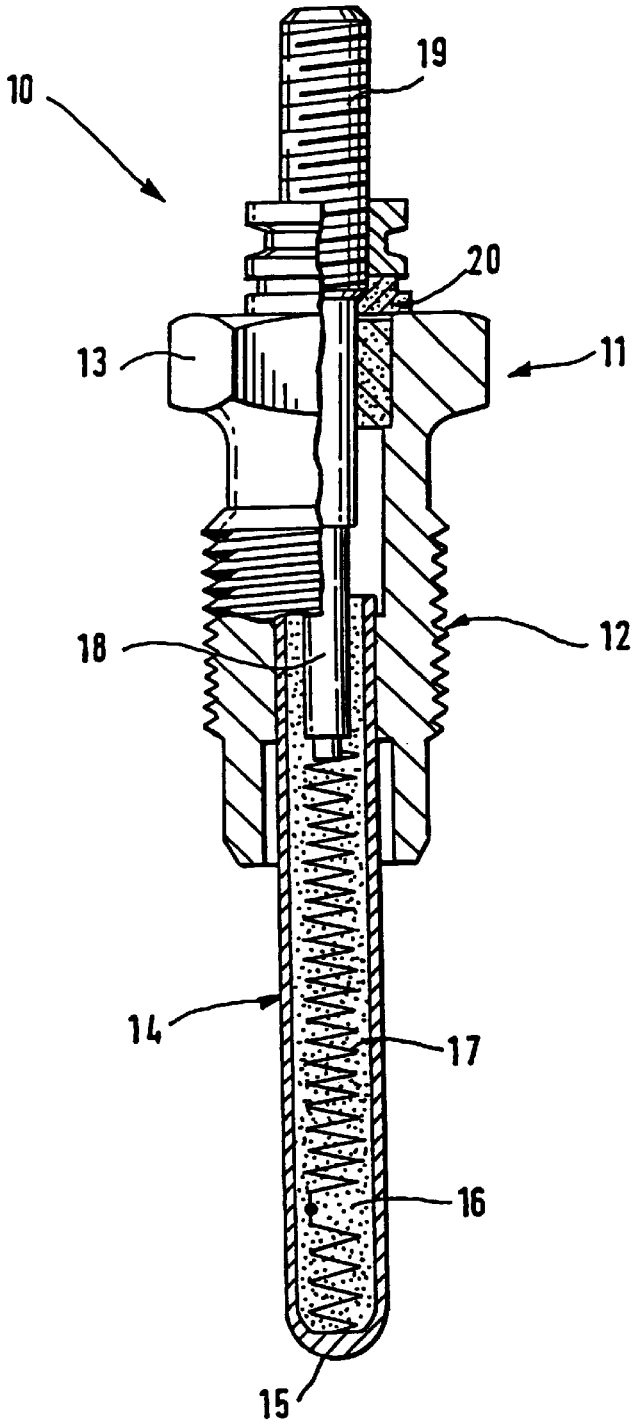
Fig. 1 Prior Art
FIG. 1 depicts the principle structure of a sheathed-element glow plug according to the prior art.

The sheathed-element glow plug depicted in FIG. 1 is comprised of a sheath 11 having a thread 12 and a hexagonal part 13. Sheath 11 is traversed by an axial bore, a glow pencil 14 being secured at its one end in the combustion chamber-end of sheath 11. The other end 15 of glow pencil 14, protruding into the combustion chamber, is sealed. Glow pencil 14 is made of a temperature-resistant material. Contained inside the glow pencil are insulating ceramic powder 16 and a wire filament arrangement which functions as a heating element. Wire filament arrangement 17 includes a heating filament having constant resistance and a control coil having temperature-dependent resistance. The free-standing end of wire filament arrangement 17 is fastened to a connector element 18 which protrudes into glow pencil 14. The combustion chamber-end of wire filament arrangement 17 is electrically connected to sealed end 15 of glow pencil 14. Connector element 18 is secured in sheath 11 and, on the side of sheath 11 away from the combustion chamber, forms a threaded bolt 19, where the connection to the glow current is made. An insulating washer 20 prevents electrical contact from occurring between sheath 11 and terminal element 18.

Virtually all commercially available sheathed-element glow plugs are manufactured in accordance with this schematic design. However, they do vary in the length of their sheaths depending on the design requirements. As a consequence, sheaths of the greatest variety have to be available for assembly, which necessitates a very large product range.

Figure 2A:
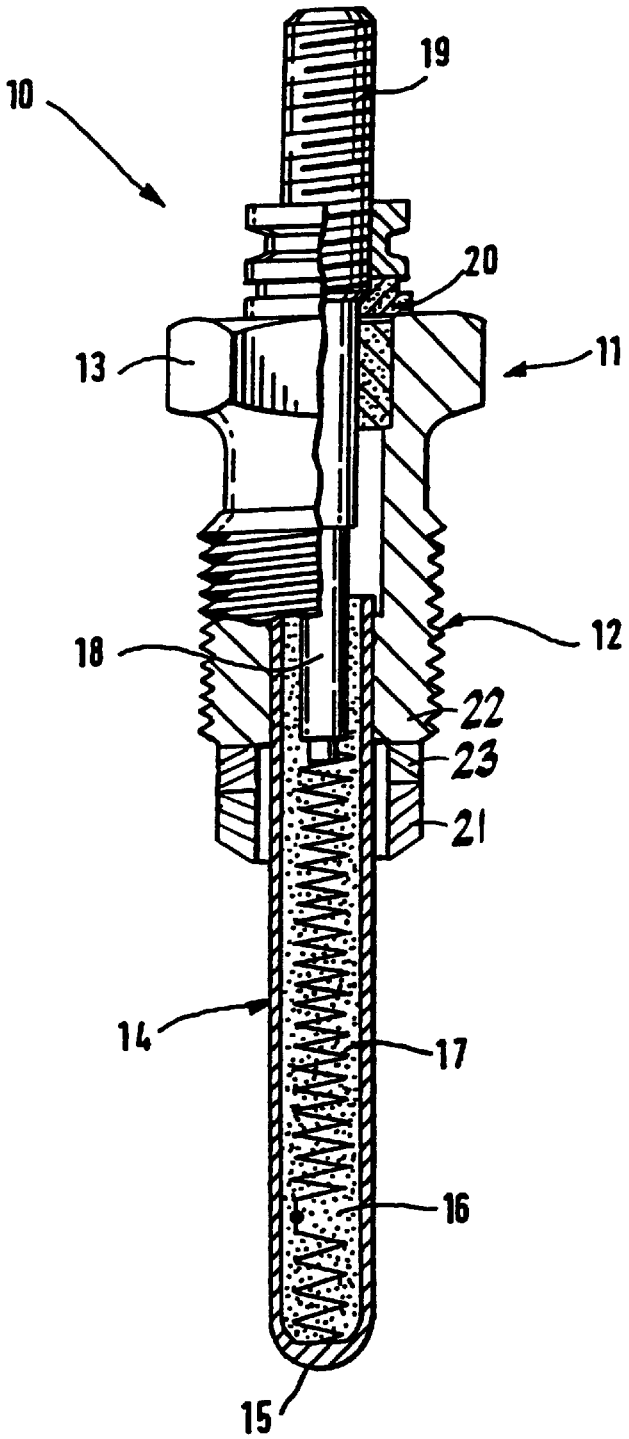
FIG. 2A depicts a sheathed-element glow plug arranged according to the present invention to have an intermediate piece for obtaining varying overall lengths.

FIG. 2A shows a sheath according to the present invention. The same parts are designated with the same reference numbers as those shown in FIG. 1. Sheath 11 is in two parts, including a first part 21, which sealingly holds glow pencil 14. The second part 22 is attached to the thread 12, for screwing the sheathed-element glow plug into the cylinder, and hexagonal part 13. The first part 21 and the second part 22 are joined together via intermediate piece 23 by, for example, welding, soldering, shrinking, or pressing. Intermediate piece 23 can be of any length, which is determined in each case as a function of the required overall length of the sheathed-element glow plug. This has the advantage that first part 21 and second part 22 of sheath 11 can be manufactured with the same geometric shape and the same dimensions.

Figure 2B:
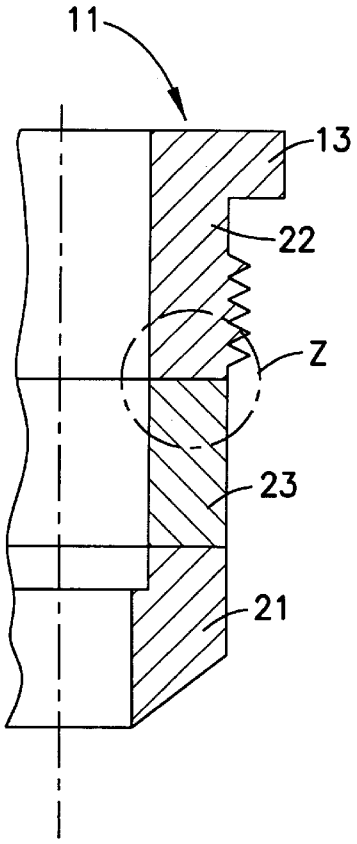
FIG. 2B depicts an enlarged illustration of a portion of the sheathed-element glow plug of FIG. 2A.

FIG. 2B shows a portion of the sheath of FIG. 2A in a cut-away representation, where, for the sake of simplicity, only one side proceeding from the axis of symmetry is depicted.

Figure 3:
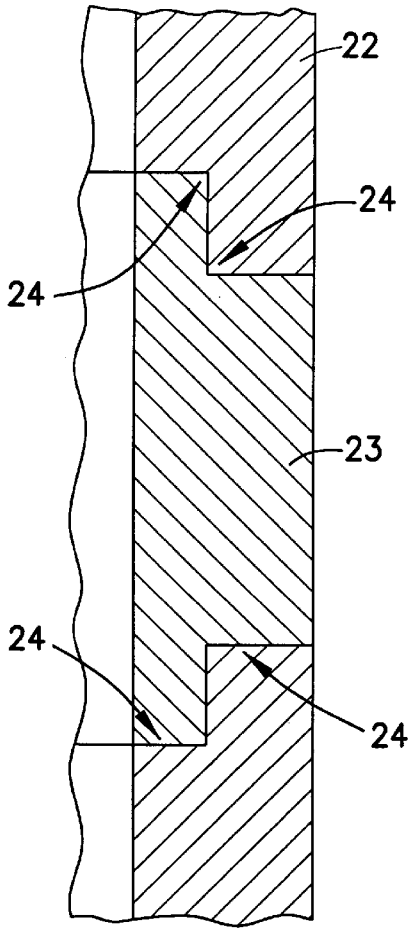
FIG. 3 depicts the joining of the intermediate piece to the sheath.

FIG. 3 depicts a further possibility for joining the first part 21 or the second part 22 of sheath 11 to intermediate piece 23. Each connecting surface contains an offset 24 to enable the individual parts being joined to be fixed in position much more effectively.

Figure 4:
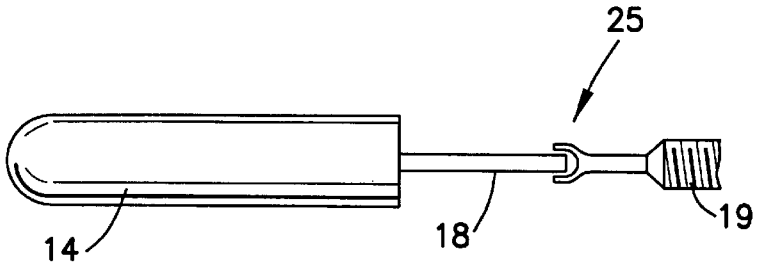
FIG. 4 depicts a glow pencil having a variable connection contact.

FIG. 4 depicts yet another possibility to adapt the internal arrangement of the sheathed-element glow plug, comprised of glow pencil 14, connector element 18, and threaded bolt 19, to various overall lengths. Glow pencil 14 and connector element 18, attached thereto, are securely preassembled longitudinally. In conformance with the overall length of the sheathed-element glow plug, the appropriate length of threaded bolt 19 is used. Threaded bolt 19 is secured to connector element 18 using connection 25 by welding, soldering, or friction welding.

What is claimed is:

1. A sheathed element glow plug, comprising:

a sheath having a first part and a second part;

a connector element for a glow current secured within the sheath;

a threaded bolt contacting the connector element and having a length dependent on a required overall length of the sheathed element glow plug;

a tube attached to the sheath, the tube having a sealed end facing away from the sheath; and a wire filament arrangement in an insulating material disposed in a portion of the tube that protrudes from the sheath.

2. A sheathed element glow plug, comprising:

a sheath having a first part, a second part, and an intermediate piece, the second part having a threaded part and a hexagonal part, the threaded part for fastening via screwing-in, the intermediate piece having a length dependent on a required overall length of the sheathed element glow plug, the intermediate piece being attached to the first part and the second part;

a connector element for a glow current connected to the sheath;

a tube attached to the sheath, the tube having a sealed end facing away from the sheath; and a wire filament arrangement in an insulating material disposed in a portion of the tube that protrudes from the sheath.

3. The sheathed element glow plug according to claim 2, wherein the intermediate piece is attached to the first part and the second part by at least one of welding, soldering, shrinking, and pressing.

4. The sheathed element glow plug according to claim 2, wherein the first part has a first end face having a first offset;

the second part has a second end face having a second offset;

the intermediate piece has a third end face having a third offset and a fourth end face having a fourth offset, wherein the third end face is positioned longitudinally opposite from the fourth end face; and the first end face is attached to the third end face, and the second end face is attached to the fourth end face.

* * * * *